United States Patent [19]

Fukuda et al.

[11] 3,978,298

[45] Aug. 31, 1976

[54] MINIATURE SWITCH HAVING PIVOTAL ACTUATOR WITH BUDGING CONTACT AND POSITION SAFETY STRUCTURE

[75] Inventors: Hiroshi Fukuda; Makoto Yoshii; Wataru Asami, all of Tokyo, Japan

[73] Assignee: Matsu Kyu Kabushiki Kaisha, Tokyo, Japan

[22] Filed: Jan. 8, 1975

[21] Appl. No.: 539,431

[30] Foreign Application Priority Data

Jan. 11, 1974 Japan ..... 49-6812[U]

[52] U.S. Cl. ..... 200/6 R; 200/6 BB; 200/6 C; 200/275; 200/303; 200/333; 200/334; 200/5 B

[51] Int. Cl.[2] ..... H01H 21/18; H01H 1/12; H01H 9/28

[58] Field of Search ..... 200/6 R, 6 B, 6 BA, 200/6 BB, 6 C, 7, 11 J, 16 A, 67 R, 67 D, 67 G, 67 PK, 68, 70, 76, 154, 155 R, 159 A, 164 R, 241, 242, 243, 252, 253, 275, 283, 302, 335, 336, 340, 5 B, 333, 334

[56] References Cited

UNITED STATES PATENTS

| | | | |
|---|---|---|---|
| 2,723,327 | 11/1955 | Gilbert | 200/155 R X |
| 2,813,158 | 11/1957 | Hutt | 200/6 BB |
| 2,921,147 | 1/1960 | Hutt | 200/6 BB |
| 3,019,323 | 1/1962 | Daniels | 200/164 R X |
| 3,239,637 | 3/1966 | Pierce | 200/164 R |
| 3,519,775 | 7/1970 | Weremey | 200/6 BB |
| 3,878,344 | 4/1975 | Lockard | 200/6 BB |
| 3,883,705 | 5/1975 | Sebastian et al. | 200/6 B |
| 3,917,921 | 11/1975 | Jakubauskas | 200/333 |

*Primary Examiner*—James R. Scott
*Attorney, Agent, or Firm*—Haseltine, Lake & Waters

[57] ABSTRACT

A miniature switch assembly comprising a base member having a plurality of parallel finned projections, a pair of contact members each having a plurality of contact terminals being fixed on both sides of the base member, respectively, a plurality of lever wheels being disposed between the adjacent finned projections, and a housing having a plurality of partition walls for accommodating the base member with the contact members and the lever wheels, wherein the lever wheels each having conductive plate perform the switching action in a manner that the conductive plate slides over the contact terminals. A locking member is also provided for locking the lever wheels. Preferably, a dust cover is provided for protecting the switch assembly from dust or mechanical injuries.

8 Claims, 16 Drawing Figures

FIG. 1 (a)
PRIOR ART
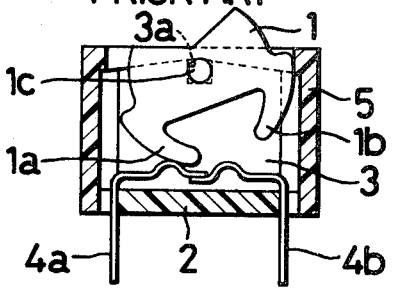
FIG. 1 (b)
PRIOR ART
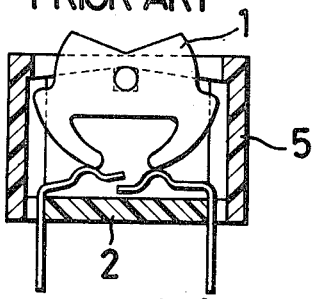
FIG. 1 (c)
PRIOR ART
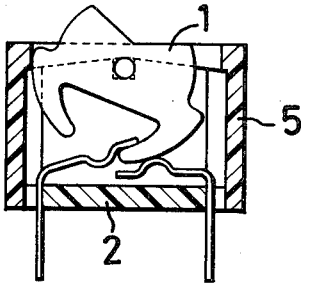
FIG. 1 (d)
PRIOR ART
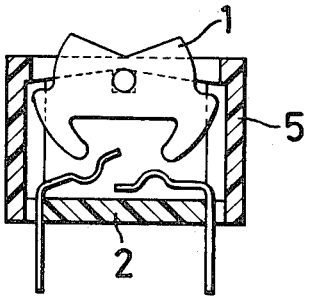
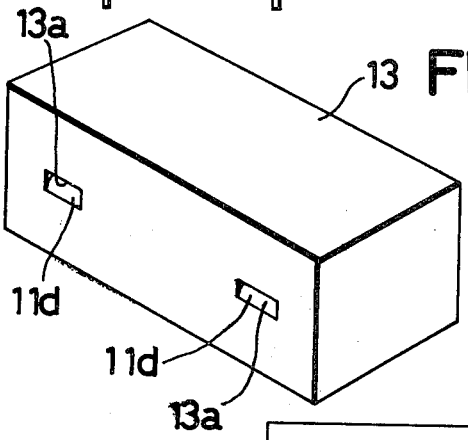
FIG. 2 (a)
FIG. 2 (b)
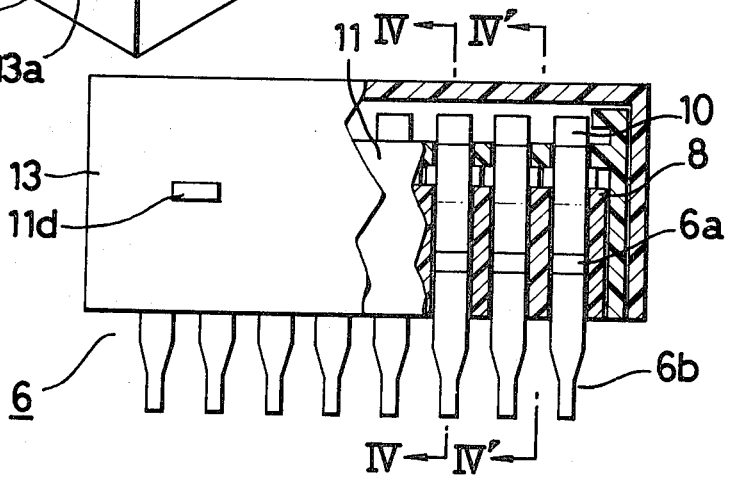

MINIATURE SWITCH HAVING PIVOTAL ACTUATOR WITH BUDGING CONTACT AND POSITION SAFETY STRUCTURE

FIELD OF THE INVENTION

The present invention relates to a miniature switch and more particularly a multi-miniature switch adaptable for printed-circuit boards or integrated circuits.

DESCRIPTION OF THE PRIOR ART

Recent rapid progress of miniaturization of electric circuits urgently necessitates the miniaturization of the associated components. A miniature switch used for the printed circuit board, etc. as an example of such components which is now available, is few in kind and suffers from many disadvantages. For example, the size of the conventional switch of this type is excessively large for mounting on such board, and adversely lead wires are necessary. Insertion of the conventional switch into the socket or the plug socket is impossible so that it is inconvenient when it is required to exchange. Further, the contacts and the associated parts thereof are imperfectly sealed with the result that the reliability of the switching action is poor.

Since the prior art switch is thus constructed, it suffers from additional disadvantages. First is that contaminants due to dust easily get on the contact members. Second is that when the printed circuit board is inserted, if the switch mounted thereto contact with something, the switch is erroneously acted. The third disadvantage is a large difference between the depression forces of the lever wheel for the ON-condition and the OFF-condition. The fourth disadvantage is the fact that the application of vibration to the switch causes the lever wheel slightly to swing and thus the change of contact resistance between the contact members.

SUMMARY OF THE INVENTION

It is thus a primary object of the present invention to provide a miniature switch assembly whose contacts are free from contaminants by dust and mechanical deformation.

Another object of the present invention is to provide a miniature switch diminating erroneous switching action.

Still another object of the present invention is to provide a miniature switch which may be assembled in few steps.

The present invention may be briefly summarized as involving a miniature switch assembled from a base member, a pair of contact members each having a plurality of contact terminals, a plurality of lever wheels, and a housing accommodating these members assembled, and preferably a locking member for locking the lever wheels, wherein the conductive portion of the lever wheel slides over the contacts of the contact terminals for effecting the switching operation. The invention is, of course, more fully summarized by the appended claims forming a part of this description.

These and other objects and advantages inherent in this invention will be apparent from the following detail description, taken in connection with the accompanying drawings, wherein:

BRIEF DESCRIPTION OF THE DRAWINGS

FIGS. 1(*a*) to (*d*) show in cross-section form a series of switch positions of the prior art switch assembly and its construction;

DETAILED DESCRIPTION OF THE INVENTION

Figure 2C:
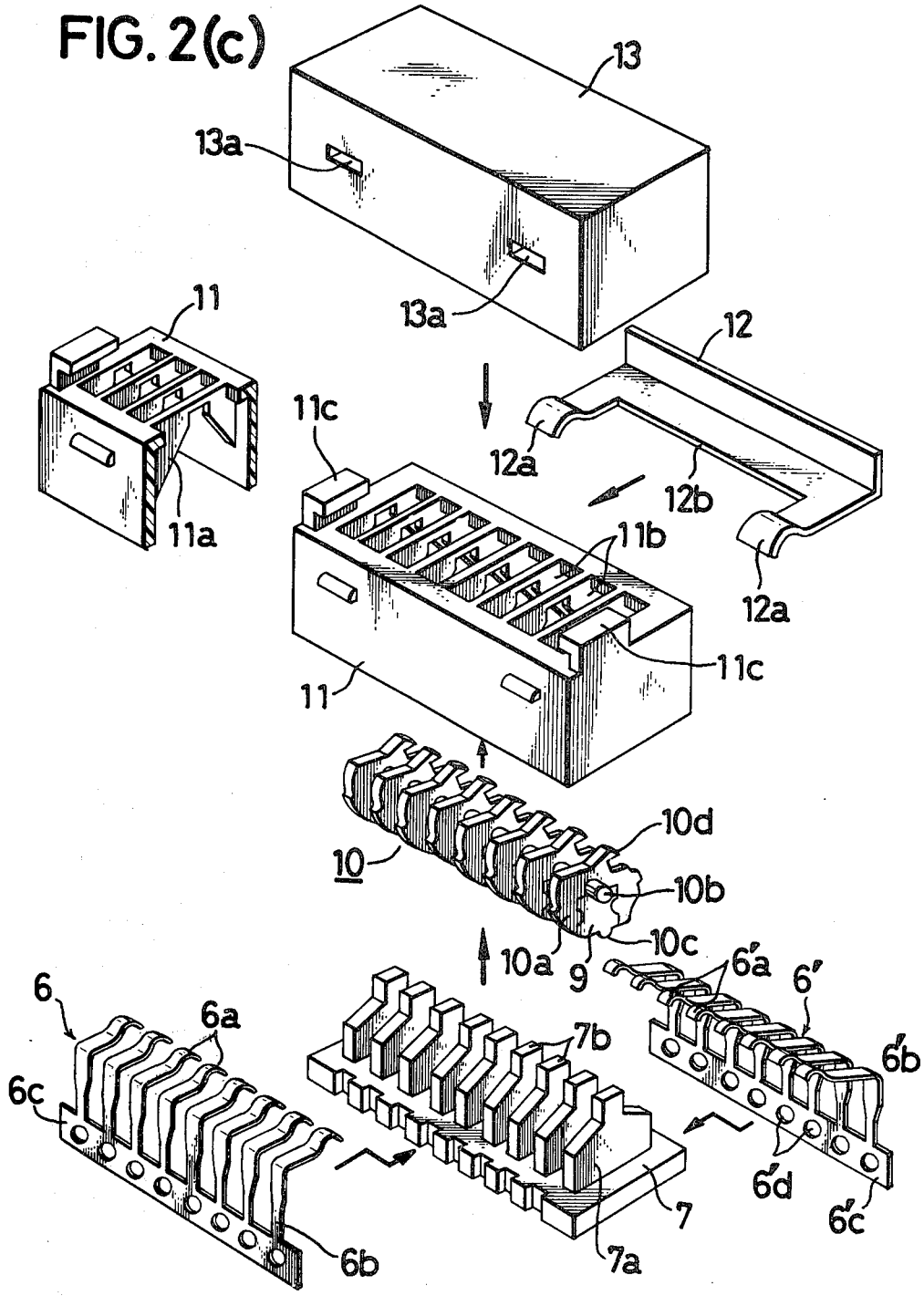
FIG. 2(*a*) is a perspective view of a switch assembly according to the present invention for illustrating an appearance thereof, FIG. 2(*b*) is a side elevation partly broken away for illustrating the interrelation among the respective components constituting the switch assembly according to the present invention, FIG. 2(*c*) is a fragmentary, exploded view of the switch assembly according to the present invention, FIGS. 3(*a*) to (*c*) are a plan view, a front view and a side view of the miniature switch assembly of the invention when it is assembled with the dust cover having been removed.

Before proceeding with the description of the present invention, one form of the conventional or prior art miniature switch will be described for a better understanding of the present invention. Throughout the drawings of the specification like reference numerals are used to designate like parts or equivalent parts. Reference is now made to FIGS. 1(*a*) and (*b*) illustrating a series of switching positions of one form of the prior art switches, and its construction.

More details of the prior art will be described referring to FIGS. 1(*a*) to (*d*) illustrating a series of switching positions of one form of the prior art switches and its construction. As shown in the figures, the axle projection 1*c* of a lever wheel 1 is fitted into a groove 3*a* of an insulating wall 3 upstanding from a base member 2, permitting the lever wheel to be swingable. Elastic contact members 4*a* and 4*b* being partly overlapping each other are supported by the base member 2. The lever wheel 1 is provided at the lower part with a pair of legs 1*a* and 1*b*. Reference numeral 5 designates a casing.

FIG. 1(*a*) shows an ON-condition of the switch. That is, the leg 1*a* of the lever wheel 1 presses the contact member 4*a* down thereby to contact with another contact member 4*b*. On the other hand, FIG. 1(*c*) shows an OFF-condition of the switch in which the leg 1*b* of the lever wheel 1 is inserted between the contact member 4*a* and 4*b*, thereby to separate these contact members. This forcible inserting action of the lever wheel tends to deform the contact members 4*a* and 4*b*. If they aree deformed, there is a high possibility that both the contact members 4*a* and 4*a* would be in contact with each other, in case where the lever wheel is positioned as shown in FIGS. 1(*b*) and (*d*).

Turning now to FIG. 2(*a*), there is shown a perspective view of a miniature switch assembly of the present invention covered with a dust cover 13 for protecting the switch assembly to be described later from dusts and from unexpected mechanical injuries.

FIG. 2(*b*) shows a side elevation partly broken away for illustrating generally the interrelation among the respective components constituting the switch assembly of the present invention.

Those components and the interrelation thereof will be described in detail with reference to FIGS. 2(*c*), 3, 4(*a*), 4(*b*), and 4(*c*).

As seen from FIG. 2(*c*), the switch assembly of the present invention is assembled from a base member 7, contact members 6 and 6', a plurality of lever wheels as actuators 10, a housing 11, a locking member 12, and a dust cover 13.

The base member 7 of electrically insulating material is provided with a plurality of parallel spaced finned projections 8 which are preferably integral with the base member 7 through, for example, a conventional moulding method. Each finned projection has a flat top end 8*a* which may be provided with a notch thereacross centrally thereof for permitting one of axle projections 10*a* of the lever wheel 10 to be rotatably seated therein. The base member 7 is provided on each side with a series of projections 8*b* which are to be fitted into the holes 6*d* and 6'*d* of the contact member 6 and 6' for fixing the contact member to the base member 7, when in assembling work.

The contact member 6 of resilient conductive material includes a plurality of leaf contacts 6*b* each having generally L-shaped configuration and an end of an upwardly arcuated configuration. The contact member 6 may be stamped from metal strip. As seen from the figure, the respective leaf contacts 6*b* are commonly and integrally connected with a common strip 6*c* which is cut away after the completion of switch assembling to form individual leaf contacts 6*b*, as shown in FIGS. 2*b* and 3*b*. It is preferable that the arcuated end contact 6*a* each are furcated to obtain a more reliable contact with a conductive strip 9 of the actuator, or the lever wheel 10. The respective parts of the contact member 6' which is a counterpart of the contact member 6 are designated by like reference numerals each with prime. A pair of individual leaf contacts 6*b* and 6'*b* are disposed in a diametrically opposited disposition between adjacent finned projections 7*a*, as shown in FIGS. 4*a* and 4*b*.

The lever wheel 10 includes an insulating body 10*a* having a pair of axle projections 10*b* integrally projecting from the respective side walls of the insulating body 10*a*, a projection 10*d* from the bottom thereof, and a conductive plate 10*c* covering both the sides of the insulating body extending from the bottom to the middle portion. The conductive strip is relatively extensive. This is important in that it provides a relatively large area for heat dissipation. That is, with such conductive strip, melting of the resin as the insulating material possibly occurring when soldering is avoidable. The lever wheel 10 which is swingably supported by the axle projections 10*b* seated on the flat tops 7*b*, is swingable from a first position of ON-condition to a second position of OFF-condition. (See FIGS. 4*a* and 4*b*) A slit 10*d* is further formed on the upper side portion of the lever wheel 10, and adapted to receive a locking member 12 to be described later.

A housing 11 is used for covering thus assembled base member 7 while permitting the actuators to freely swing. The housing 11 is provided on each of the longer side walls with a pair of projections 11*d* as stoppers which are inserted into corresponding holes 13*a* (see FIGS. 3(*a*) and (*c*)) of the dust cover 13 when the dust cover 13 fits in with the housing 11. As seen from the figure, a pair of L-shaped projections 11*c* are integrally formed in an opposite disposition on both sides of the top of the housing 11.

The housing 11 has a plurality of parallel partition walls 11*a* each of which is cut away inverse U. When assembling, the respective inverse U cut away portions receive the finned projections 8 of the base member 7 thereby to complete a parallel partition wall continuing from the bottom to the top of the housing 11. It should be noted, here, that each thus completed partition wall has a gap between the top end 8*a* of the finned projection 8 and the portion wall 11*a*. As will be apparent below, when assembling, the axle projections 10*a* of the lever wheel 10 are placed on the flat top ends 8*a* of the adjacent finned projections 8, and then the housing 11 is set over such base member with the lever wheel. Accordingly, the gap is necessary to receive the axle projections 10*a* rotatably. A reference numeral 12 designates a locking member which is held by holders 11*c*.

The locking member 12 with two legs whose free ends 12*a* are arcuated is used for locking the actuator 10 of lever wheel. On locking, the locking member is so slide that the respective arcuated free ends 12*a* are forcibly inserted into the spaces defined by the L-shaped projections, respectively (see FIGS. 4(*a*), (*b*) and (*c*)), while the extensive linear bottom 12*b* of the U of the locking member 12 is inserted into the slit 10*d* of the selected actuators 10 (see FIGS. 4(*a*) and (*c*)) and at the same time slide over the top surface shaped V of non-selected actuators 10 (see FIG. 4(*b*)).

Figures 5A, 5B, 5C:
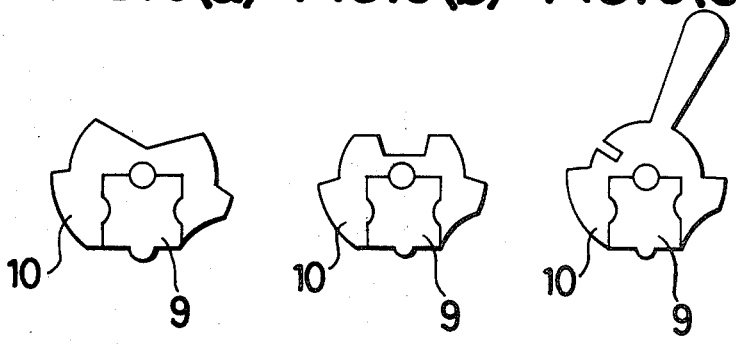
FIGS. 5(*a*) to (*c*) are views of an actuator employed in the switch assembly of the present invention.

The lever wheel 10 includes a conductive plate 9 having a projection 10*c*, a slit 10*b* adaptable for receiving the stopper 12, and the axle projections 10*a* on both sides thereof. The lever wheel of the present invention may be applicable for any type of switch, as shown in FIGS. 5(*a*) to (*c*). FIG. 5(*a*) is a seesaw type switch which is now employed in this embodiment of the present invention, FIG. 5(*b*) a push-button switch and FIG. 5(*c*) a toggle switch. When the inverse U shaped contacts 6*a* and 6'*a* are furcated, as previously stated, it is preferable correspondingly to furcate the projection 10*c*.

A dust cover 13 is used to protect the switch assembly from dusts invading thereinto. Holes 13*a* of the dust cover 13 receive stoppers 11*d* of the housing 11 for fastening the dust cover to the switch assembly.

Figure 3:
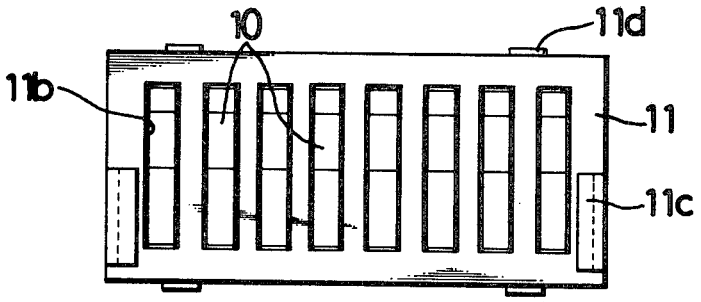
Figure 3:
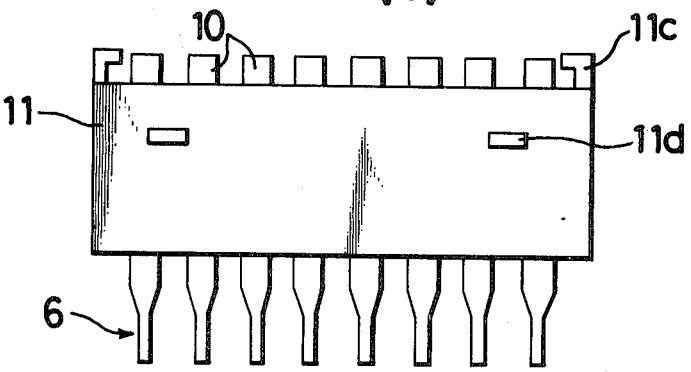
Figure 3:
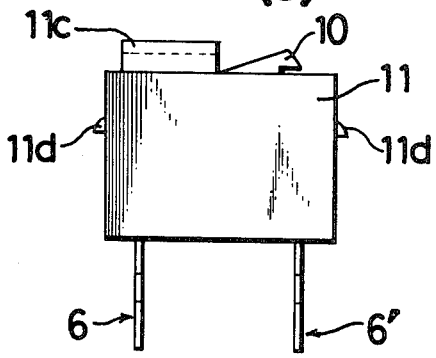
Figure 4A:
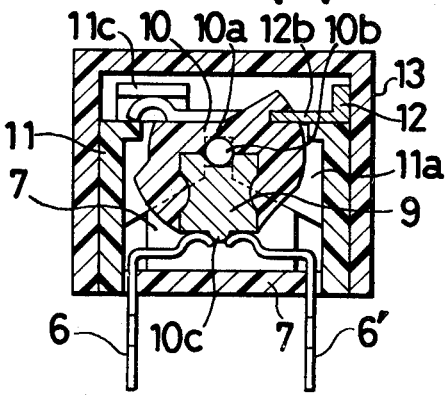
FIGS. 4(*a*) and (*b*) are cross sectional views of the miniature switch assembly according to the present invention, taken along line IV′—IV′ in FIG. 2(*b*)
Figure 4B:
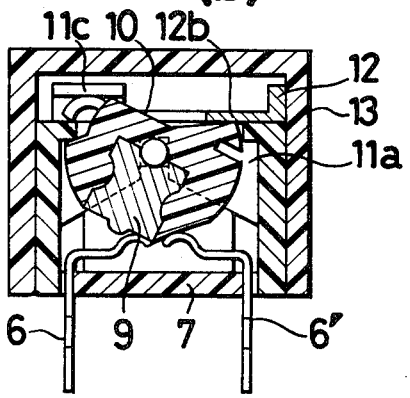

FIGS. 3(*a*) to (*c*) illustrate the switch assembly without the locking member 12 and the dust cover 13, in which FIG. 3(*a*) is a plan view, FIG. 3(*b*) a front view, and FIG. 3(*c*) a side view. In the figures, the lever wheel 10 are all positioned at the first position of ON-condition, and the common strip is not yet cutaway.

Figure 4C:
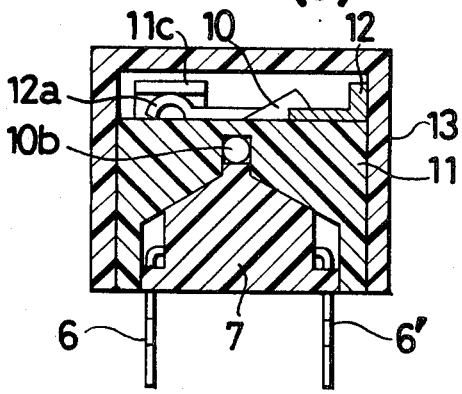

FIG. 4(*a*) heretofore frequently referred to mainly illustrates the ON-condition of the switch assembly with the lever wheel locked by the locking member 12. FIG. 4(*b*) illustrates the OFF-condition of the switch assembly with lever wheel locked by the locking member 12. FIG. 4(*c*) illustrates the interrelation of the base member 7, the housing 11, the lever wheel 10, the locking member 12, the L-shaped projection 11*c*, and the dust cover 13.

The lever wheel 10 may be applicable for any type of switch, as shown in FIGS. 5(*a*) to (*c*). FIG. 5(*a*) is a seesaw type switch which is now employed in this embodiment of the present invention, FIG. 5(*b*) a push-button switch and FIG. 5(*c*) a toggle switch.

The assembly work of the switch may be effected through few steps. As a first step, the contact members 6 and 6' are fixed to the respective sides of the base member by fitting the respective holes 6*d* and 6'*d* of the contact members 6 and 6' with the projections 8*b*. It is to be noted that, by this fixing of the contact members on both sides of the base member, a pair of contact terminals 6*b* are disposed in each space between the adjacent parallel finned projections, in opposite relation and facing the respective inverse U shaped contacts each other, as shown in FIGS. 4(*a*) and (*b*). As a second step, the lever wheel 10 is disposed in each space defined by the adjacent finned projections of the base member 7 by resting the respective axle projections 10*a* on the corresponding flat top ends 8*a*. As a third step, the housing 11 is set over the base member with the contact members 6 and 6' and the lever wheels 10. If necessary, the dust cover 13 is set over the assembled housing 11. If it is desired to lock the lever wheels mounted, the locking member, before the dust cover 13 is set, is slided into the respective slits 11*b* of the lever wheels 10. The holders 11*c* serve to guide this sliding operation of the locking member 12 and after completion of the sliding, i.e. when the straight portion 12*b* is fitted into the respective slits 10*b*, the locking member 12 is held by the holders 11*c* with an aid of stopper 12*a* of the locking member 12.

FIGS. 5(*a*) to (*c*) illustrate the assembled switch without the locking member 12 and the dust cover 13, in which FIG. 5(*a*) is a plan view, FIG. 5(*b*) a front view, and FIG. 5(*c*) a side view of the assembled switch. Incidentally, the contact terminals 6*b* and 6'*b* are separated into an individual one by cutting the strip 6*b* of the contact member, after the completion of the assembly work of the switch.

As seen from the foregoing, the switch according to the present invention may be assembled through substantially a few steps only.

As a first step, the contact member 6 and 6' are fixed to the respective sides of the base member by melting the base member. It is to be noted that, by this fixing of the contact members on both sides of the base member, a pair of contacts 6*b* and 6*b'* are disposed in each space defined by the adjacent parallel finned projections, in opposite relation and facing the respective arcuated contacts 6*a* and 6*a'* to each other, as shown in FIGS. 4(*a*) and (*b*). As a second step, the lever wheel 10 is disposed in each space defined by the adjacent finned projections of the base member 7 by resting the respective axle projections 10*a* on the corresponding flat top ends 7*b*. As a third step, the housing 11 is set over the base member with the contact members 6 and 6' and the lever wheels 10. If necessary, the dust cover 13 is set over the assembled housing 11. If it is desired to lock some lever wheels mounted, the locking member is slided into the respective slits 10*d* of such lever wheels 10, before the use of the dust cover 13.

The switching action of the miniature switch is illustrated in FIGS. 4(*a*) and (*b*). In the switch of this embodiment, the lever wheels swings between two positions for effecting the switching action as previously described. First position is shown in FIG. 4(*a*) in which the switch is in ON-condition where the projection 10*c* is placed between the contacts 6*a* and 6'*a* facing each other while the both sides of the projection 10*c* are in contact with the arcuated contacts 6*a* and 6'*a* respectively. Second position shown in FIG. 4(*b*) is in OFF-condition where the conductive plate 9 contacts with the contact 6*a* alone while the contact 6'*a* faces the insulating portion of the lever wheel 10. When the lever wheel 10 swings from the first position to the second position, although it is caused by pressing down the right top (as seen in the drawing) of the lever wheel 10 in FIG. 4, the bottom projection 10*c* and both the sides thereof slides over the contacts 6*a* and 6'*a*. This sliding operation also is made when the lever wheel 10 swings in the reverse direction. It is to be noted that this sliding operation serves to clean the contact contaminants. As seen from FIG. 4, in the first position of the lever wheel 10, the slits 10*d* aligns with the horizontal line of the housing top for smoothly receiving the locking member 12, more precisely, the straight portion 12*b* thereof, and, at the second position thereof, the right top of the lever wheel 10 aligns with the horizontal line of the top of the housing 11 with the result that sliding of the locking member 12 over the right top of the lever wheel is permitted. Therefore, by using the locking member, some selected switches may be locked at a first position while at the same time other non-selected switches at a second position. It should be understood that, the actuator 10 slightly contacts with the arcuated contacts 6*a* and 6'*a*, as shown in FIG. 4(*a*) and avoidable is deformation of the contact members due to the application of excessive load to the contact members, unlike the conventional switch assembly.

While the invention has been particularly described with reference to preferred embodiment, changes and modifications may be easily possible to those skilled in the art. But it is intended to cover all the changes and modifications which do not constitute departures from the spirit and scope of the invention.

What is claimed is:

1. A miniature switch assembly comprising:

a. a base member including a bottom of four-sided plane and a pair of parallel spaced walls projecting from the respective opposite sides of said bottom;

b. a pair of contacts being disposed between said pair of parallel spaced walls, said each contact being shaped L of which one leg is secured on one of another pair of opposite sides of said bottom, while the other leg has an arcuated portion at the free end, said pair of contacts being disposed such that the free ends of said other legs of said respective L-shaped contacts being opposite to each other;

c. an actuator including an insulating and a conductive portion, said actuator being swingable between a first and a second position around a shaft constituted by a pair of projections each being projected from one side wall of said insulating portion, said shaft being rotatably seated on the tops of said adjacent parallel spaced walls, said including portion being further provided at the bottom with a projection, said conductive portion occupying the bottom portion including said bottom projection, whereby, when said actuator is in the first position, said bottom projection is placed between said free ends oppositely disposed of said pair of contacts and said conductive portion bridging said free ends of said contacts, while said actuator is in the second position, said projection is slipped out of the space between said free ends of said contacts and hence the bridging of said conductive portion between said free ends is broken; and d. a housing for covering an assembly consisting of said base member, said pair of contacts and said actuator, said housing being provided with a plurality of partition walls each having a configuration substantially complementary to each of said parallel spaced walls while having a notch for rotatably holding said shaft of said actuator when said housing fits in with said assembly.

2. A miniature switch assembly as claimed in claim 1, in which said conductive portion extends from the bottom to the middle portion of said insulating portion.

3. A switch assembly as claimed in claim 1, comprising a locking means, said actuator further having a slot for receiving said locking means.

4. A switch assembly as claimed in claim 1, in which said arcuated contacts are each furcated for ensuring a reliable contact of said arcuated contact with said conductive portion.

5. A miniature switch assembly comprising:

a. a base member including a bottom of four-sided plane and a plurality of parallel spaced walls projecting from said bottom;

b. a plurality of pairs of contacts each of which is disposed between said adjacent parallel spaced walls, said each contact being shaped L of which one leg is secured on one of the sides of said bottom which are normal to said spaced walls, while the other leg has an arcuated portion at the free end, said each pair of contacts being opposite to each other;

c. a plurality of actuators each including an insulating and a conductive portion, said actuator being swingable between a first and a second position around a shaft constituted by a pair of projections each being projected from one side wall of said insulating portion, said shaft being rotatably seated on the tops of said adjacent parallel spaced walls, said insulating portion being further provided at the bottom with a projection, said conductive portion occupying the bottom portion including said bottom projection, whereby, when said actuator is in the second position, said bottom projection is slipped out of the space between said free ends of said contacts and hence the bridging of said conductive portion between said free ends is broken; and, d. a housing for covering an assembly consisting of said base member, said pair of contacts and said actuator, said housing being provided with a plurality of partition walls each having a configuration substantially complementary to each of said parallel spaced walls while having a notch for rotatably holding said shaft of said actuator when said housing fits in with said assembly.

6. A switch assembly as claimed in claim 5, in which said conductive portion extends from the bottom to the middle portion of said insulating portion.

7. A switch assembly as claimed in claim 5, comprising a locking means, each of said actuators having a slot for receiving said locking means.

8. A switch assembly as claimed in claim 5, in which said arcuated contacts are each furcated for ensuring a reliable contact of said upward arcuate contact with said conductive portion.

* * * * *